US008733674B2

(12) United States Patent
Kajuch

(10) Patent No.: US 8,733,674 B2
(45) Date of Patent: May 27, 2014

(54) BODY SPRAY NOZZLE

(75) Inventor: Pete Kajuch, Brookfield, WI (US)

(73) Assignee: Kohler Co., Kohler, WI (US)

( * ) Notice: Subject to any disclaimer, the term of this patent is extended or adjusted under 35 U.S.C. 154(b) by 622 days.

(21) Appl. No.: 12/433,492

(22) Filed: Apr. 30, 2009

(65) Prior Publication Data

US 2010/0276518 A1 Nov. 4, 2010

(51) Int. Cl.
*B05B 3/04* (2006.01)
*B05B 3/02* (2006.01)
*B05B 15/06* (2006.01)

(52) U.S. Cl.
USPC ..... 239/587.4; 239/240; 137/625.31

(58) Field of Classification Search
CPC ..... B05B 3/04; B05B 3/02; B05B 3/025; B05B 3/0422; B05B 15/08; B05B 15/06; B05B 15/067
USPC ..... 239/240, 242, 225.1, 587.4, 587.5, 588, 239/587.3, 587.2; 137/625.31
See application file for complete search history.

(56) References Cited

U.S. PATENT DOCUMENTS

| | | | | |
|---|---|---|---|---|
| 2,756,108 | A | 7/1956 | Warren | |
| 3,902,671 | A * | 9/1975 | Symmons | 239/428.5 |
| 4,497,444 | A | 2/1985 | Arnold | |
| RE32,386 | E * | 3/1987 | Hunter | 239/206 |
| 4,651,770 | A | 3/1987 | Denham et al. | |
| 5,205,490 | A * | 4/1993 | Steinhardt et al. | 239/449 |
| 5,299,743 | A | 4/1994 | Sieth et al. | |
| 6,170,765 | B1 | 1/2001 | Gil et al. | |
| 6,607,148 | B1 * | 8/2003 | Marsh et al. | 239/447 |
| 7,004,410 | B2 | 2/2006 | Li | |
| 7,455,247 | B2 | 11/2008 | Kajuch | |
| 2005/0156062 | A1 * | 7/2005 | Thomas et al. | 239/548 |
| 2006/0196972 | A1 * | 9/2006 | Kajuch | 239/451 |

FOREIGN PATENT DOCUMENTS

| | | |
|---|---|---|
| DE | 4109003 | 5/1992 |
| DE | 10232463 | 1/2004 |
| DE | 102006033410 | 1/2008 |

OTHER PUBLICATIONS 13 pages of an PCT search report dated Jul. 28, 2010 in the corresponding PCT US2010/032011 application.
Notification of First Office Action regarding Chinese Application No. 201080029075.2 dated Dec. 4, 2013.

* cited by examiner

*Primary Examiner* — Justin Jonaitis
(74) *Attorney, Agent, or Firm* — Foley & Lardner LLP

(57) ABSTRACT

A compact body spray nozzle is disclosed that includes a spray face that can be tilted to suit the requirements of the bather. The spray face is coupled to a spray body housing that is tiltable about the exterior surface of an internal stem driver ball. The stem driver ball is also coupled to a ceramic disk valve, and flow to the spray face through the ceramic disk valve is controlled by rotating the stem driver ball. An internal key index can be used to select a range of flow from the ceramic disk valve.

20 Claims, 5 Drawing Sheets

BODY SPRAY NOZZLE

FIELD OF THE INVENTION

This invention relates to body spray nozzles, such as those used in shower enclosures. More particularly the invention is directed to body spray nozzles that are compact, while still facilitating both directional and volume control.

BACKGROUND OF THE INVENTION

One type of shower nozzle is called a "body spray nozzle". This is because it is designed to be mounted lower in the shower than a conventional overhead shower head, so as to deliver more of the spray to the torso.

Because these nozzles are mounted at human height they are designed to project out less into the showering space than overhead nozzles, to minimize the likelihood of a human bumping into them. This can add complexity, particularly when designing them to permit both directional and volume control.

U.S. Pat. No. 7,004,410, for example, discloses a shower head where the outer housing is tiltable about a fixed ball to alter spray direction. U.S. Pat. No. 5,205,490 teaches a body spray that can be angularly adjusted and also provides flow control. A problem with such prior art nozzles, however, is that the mechanisms used to tilt or control flow are typically not compact. This can waste space in or behind the shower stall, and can add cost. Additionally, some of these nozzles are not aesthetically pleasing.

Hence, a need exists for improved body spray nozzles which address these concerns.

SUMMARY OF THE INVENTION

In one aspect, the present invention provides a body spray nozzle configured to receive supply fluid (e.g. water) from a source and emit the supply as a directed spray. There is a stem driver ball, a spray head housing coupled to an exterior surface of the stem driver ball and adapted to tilt about and rotate the stem driver ball, and a valve including a movable disk positioned to control flow through the nozzle. The movable disk is operatively coupled to the stem driver ball such that when the stem driver ball is rotated, the movable disk is rotated to control the rate of flow through the nozzle.

In one form a pin is coupled to an internal surface of the stem driver ball and a groove is formed in a surface of the valve to receive the pin. The groove extends along a portion of the valve between a first and a second stop element, such that as the pin is moved along the groove the position of the movable disk is adjusted, whereby the rate of flow through the valve can be is adjusted.

In another form the valve includes a valve stem coupled to the movable disk, and the valve stem includes an index key that is selectively coupled to one of a first and a second index key receptacle in the stem driver ball. The position of the index key selectively adjusts the position of the movable disk in the valve to adjust a range of available flow through the valve.

In yet another form when the index key is in the first index key receptacle, the flow of the supply of water through the valve ranges between a shut off flow position and a selected maximum flow position, and when the index key is in the second index key receptacle, the flow of the supply of water through the valve ranges between a selected minimum flow position and a selected maximum flow position.

Preferably, the valve stem has a plurality of teeth, the stem driver ball has a plurality of mating teeth that mesh with the teeth in the valve stem, the index key has a tooth that is wider than the other teeth in the valve stem, and the index key receptacles has a first and a second opening in the stem driver ball of substantially equivalent width to the index key.

In another aspect, the valve may further have a stationary disk including at least one aperture, the movable disk is adapted to selectively open and close at least a portion of the aperture in the stationary disk, and the position of the index key in the first or the second index key receptacle determines a position of the movable disk relative to the stationary disk. The stationary disk can have at least one aperture, and the movable disk is adapted to selectively open and close at least a portion of the aperture in the stationary disk. Ceramic disks are preferred.

Other refinements include:

(a) the valve having a valve stem comprising at least one coupling element for coupling the valve stem to the movable disk, and the valve stem is coupled to and rotatable with the stem driver ball; and the valve stem has a plurality of teeth and the stem driver ball has a plurality of mating teeth, the teeth and the mating teeth being meshed together wherein when the valve stem driver ball is rotated, the valve stem and movable disk are also rotated: and a stationary disk having at least one aperture, and the movable disk comprises an opening where when the valve stem driver ball is rotated, the opening in the movable disk is selectively aligned over the aperture in the stationary disk.

Another primary aspect of the invention provides a body spray nozzle with a stem driver ball, a spray head housing coupled to an exterior surface of the driver ball and adapted to tilt about and rotate the stem driver ball, and a valve housing. The valve housing has a valve stem coupled to the stem driver ball, a movable disk coupled to the valve stem, and a stationary disk including at least one aperture.

When the stem driver ball is rotated, the valve stem and movable disk are selectively rotated between at least a first position in which a supply of water flows into the valve, and a second position in which the supply of water is to at least some extent prevented from flowing into the valve. The valve stem comprises a plurality of teeth, and the stem driver ball comprises a plurality of mating teeth.

The valve further comprises a valve body coupled to the valve stem, and the valve body comprises a flow control groove having a first stop surface and a second stop surface, and wherein the stem driver ball includes a stop pin that moves along the flow control groove to limit the flow through the valve between a selected minimum and a selected maximum value. At least one of the plurality of teeth in the valve stem is formed to be wider than the other teeth in the valve stem to provide an index key, and wherein the stem driver ball comprises at least a first and a second index key receptacles sized to mate with the index key, wherein the index key is selectively positionable in one of the first and second index key receptacles to adjust an angle between the movable disk and the stationary disk.

These assemblies are extremely compact, yet permit intuitive control over both flow and spray direction. Further the can be produced and installed at competitive cost.

These and still other advantages of the invention will be apparent from the description which follows. In the detailed description below, the preferred embodiment of the invention will be described in reference to the accompanying drawings. This embodiment does not represent the full scope of the invention. Rather the invention may be employed in other embodiments. Reference should therefore be made to the claims herein for interpreting the breadth of the invention.

DETAILED DESCRIPTION OF THE PREFERRED EMBODIMENT

Figure 1:
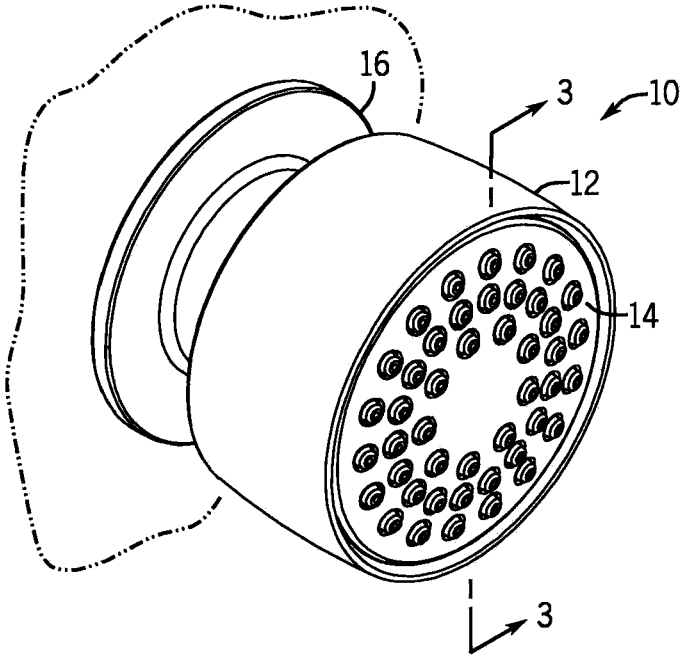
FIG. 1 is a perspective view showing a spray nozzle of the present invention mounted on a shower wall.
Figure 2:
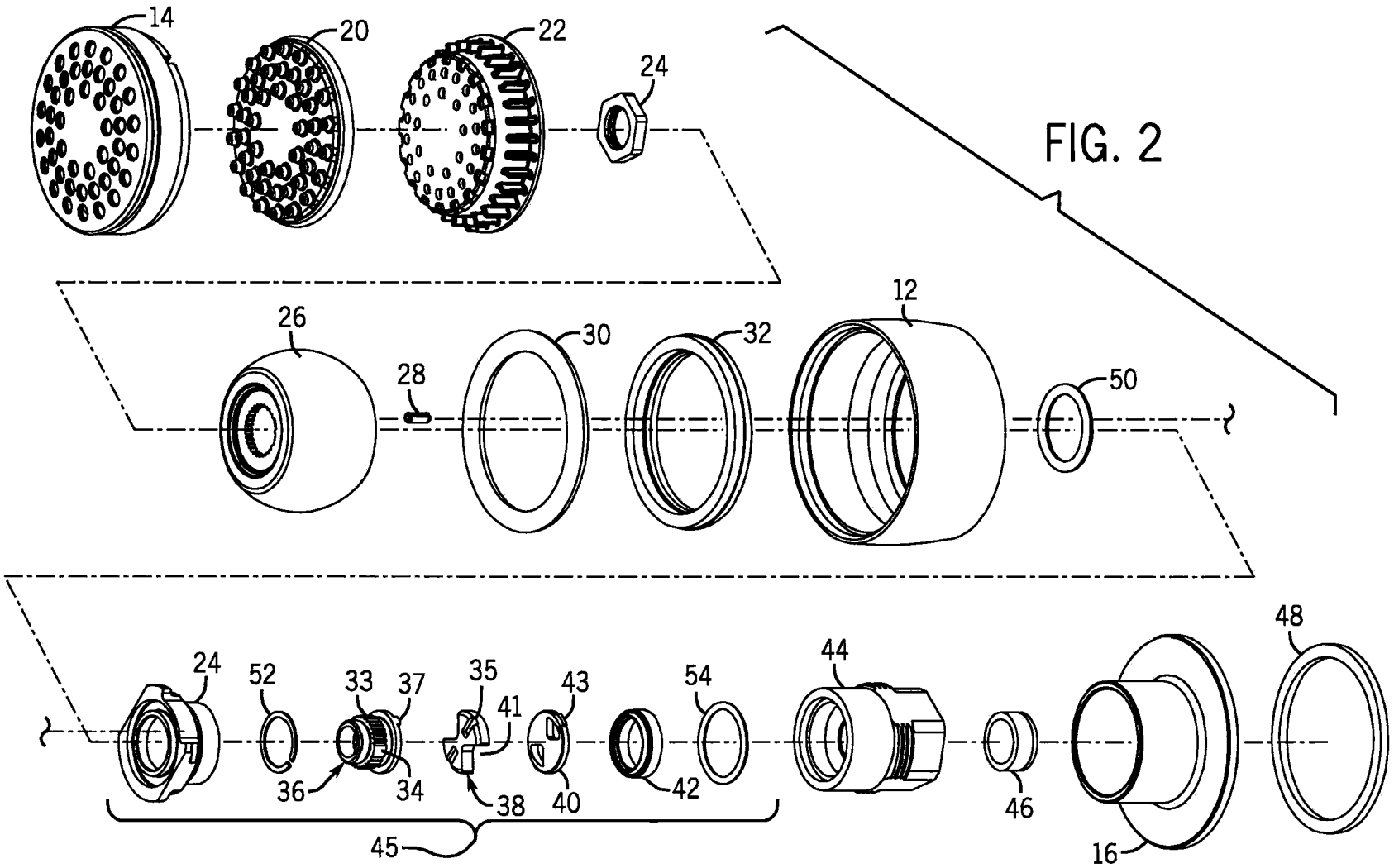
FIG. 2 is an exploded view thereof.

Referring now to the figures and more particularly to FIGS. 1 and 2, a body spray nozzle 10 constructed in accordance with the present invention is shown. The body spray nozzle 10 has a spray face 14, a spray head housing 12, and an escutcheon 16 which can be aligned, for example, against a surrounding wall containing a supply of water.

A supply of mixed hot/cold water is delivered to the nozzle through a conventional mixer valve and associated piping. Water is directed from the supply, through a ceramic disk volume control valve 45 housed in the nozzle 10, and through the spray face 14.

Figure 3:
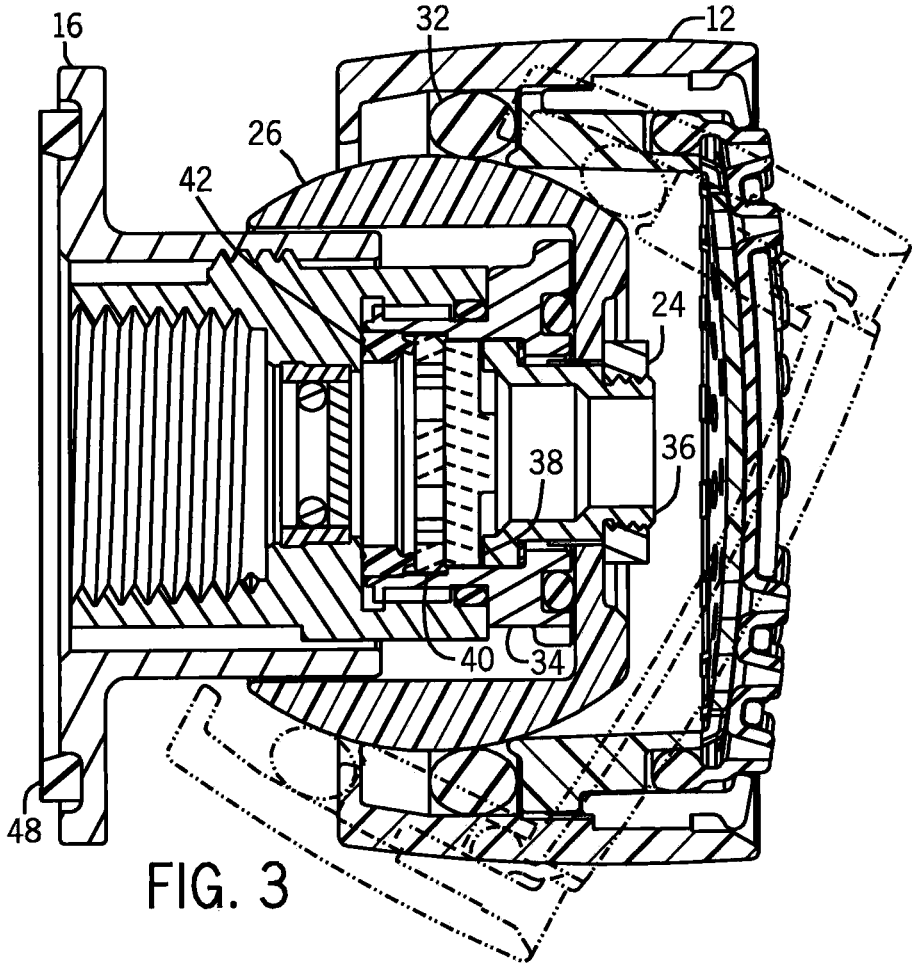
FIG. 3 is a view in section taken along line 3-3 of FIG. 1.

Referring now also to FIG. 3, the spray head housing 12 is coupled to the exterior surface of a stem driver ball 26, and can be rotated about the stem driver ball 26, allowing a user to tilt the spray head housing and corresponding spray face 14 to a desired orientation, and to adjust the flow, as described below. The stem driver ball 26 is coupled to the spray housing 12 through an O-ring seal 30 and bearing 32, which allows rotation of the stem driver ball 26 as discussed above.

The spray face 14 is coupled to the opposing end of the spray head housing 12, through a nozzle membrane 20 and a membrane support 22. Water is directed into the nozzle 10 through the escutcheon 16, which is configured to be coupled to a surface containing a water supply through a gasket 48. A body spray housing 44, including internal threads for receipt on an input water supply pipe, is provided in the escutcheon 16, and is coupled to the ceramic disk valve 45, and optionally to a flow regulator 46. The flow regulator 46 limits the maximum flow of water supplied to the body spray nozzle from the input water supply, as is sometimes required by regulations for water conservation. The ceramic disk valve 45 adjusts the flow rate to the spray face 14.

The ceramic disk valve 45 includes a valve body 34, valve stem 36, movable disk 38, stationary disk 40, and ceramic valve seal 42. O-rings 52 and 54 are provided at opposing ends of the ceramic disk valve 45 between the valve stem 36 and valve body 34, and between the ceramic valve seal 42 and body spray housing 44. The stationary disk 40 includes apertures 43 which are selectively aligned with openings 41 in the sides of the movable disk 38 to enable water flow through the ceramic disk valve 45, and to adjust the level of water flow. The valve stem 36 is coupled to the stem driver ball 26 and to the movable disk 38 to adjust the flow, as described below. The lower surface of the valve stem 36 includes a pair of projections 37 (only one of which is shown here) that are sized and dimensioned to be received in receptacles 35 formed in an upper surface of the movable disk 38, linking the movable disk 38 to the valve stem 36.

Figure 4:
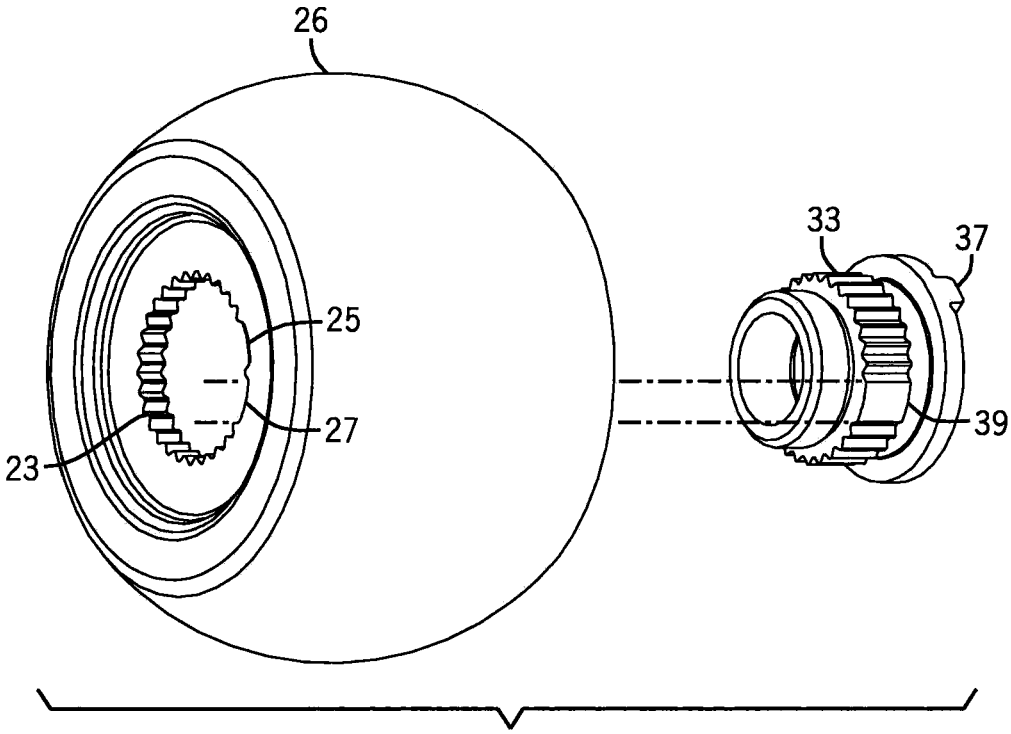
FIG. 4 is an enlarged view illustrating a stem driver ball and associated part.

Referring now also to FIG. 4, the upper portion of the valve stem 36 is cylindrical in shape and includes a plurality of teeth 33 arranged about the circumference. An index key 39, which comprises a tooth that is wider than the adjacent teeth, is formed in one side of the upper portion of the valve stem 36. The stem driver ball 26 includes an upper surface that is ring-shaped, and teeth 23 sized to mate with the teeth 33 in the valve stem 36 are provided on the inner surface of the ring. The stem driver ball 26 also includes two index key receptacles 25 and 27 that are dimensioned to mate with the index key 39 in the valve stem 36, and which can be used to adjust the position of the movable disk 38 relative to the stationary disk 40, and therefore to adjust the available flow levels through the valve 45, as described below.

Figure 5:
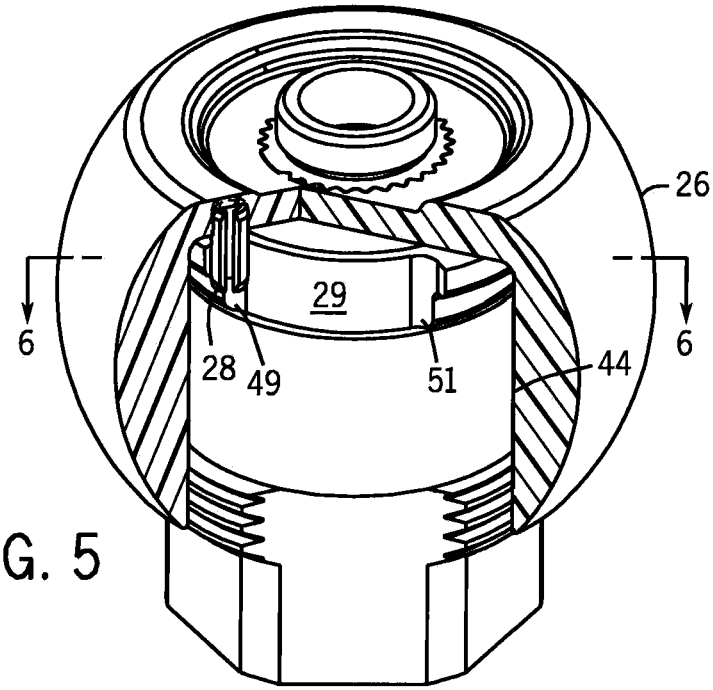
FIG. 5 is a partial sectional view of certain parts of the assembly.

Referring still to FIG. 2 and now also to FIG. 5, a flow control groove 29 is formed in the surface of the valve body 34 and includes stop elements or surfaces 49 and 51 at opposing ends of the groove 29. The groove 29 receives a stop pin 28, which is coupled inside of the stem driver ball 26, and which limits the rotational movement of the stem ball 26, and hence of the valve stem 36, and movable disk 38. The groove 29 and stop pin 28 therefore operate to limit the alignment between the openings 41 in the movable disk 38 and the apertures 43 in the stationary disk 40, and provide limits on the overall flow of water through the ceramic disc valve 45.

In operation, as the stem driver ball 26 is rotated, the meshed teeth 23 and 33 in the stem driver ball 26 and valve stem 36, respectively, cause the valve stem 36 to rotate. The valve stem 36 is coupled to movable disk 38, and therefore causes the movable disk 38 to rotate, adjusting the alignment between the openings 41 in the movable disk 38 and the apertures 43 in the stationery disk 40, and adjusting fluid flow to the spray face 14. As the stem driver ball 26 is rotated, the stop pin 28 moves along the flow control groove 29 formed in the valve body 34 between stop surfaces 49 and 51, limiting the overall rotation and the amount of flow out of ceramic disk valve 45 to a predetermined range that varies between a selected maximum flow level when positioned against stop surface 49, and a selected minimum flow level when positioned against stop surface 51.

The minimum and maximum flow levels are selected by positioning the index key 39 in the valve stem 36 in one of the mating index key receptacles 25 and 27 in the valve stem driver ball 26 (FIG. 4). The position of the index key 39 establishes the position of the valve stem 36 relative to the stem driver ball 26, and thus also the position of the moveable disk 38 relative to the stationary disk 40. The position of the index key 39 therefore determines the available range of overlap between the openings 41 in the movable disk 38 and the apertures 43 in the stationary disk 40 as the stem driver ball 26 is driven between the stop positions 49 and 51, as shown in FIGS. 6-9 below.

Figure 6:
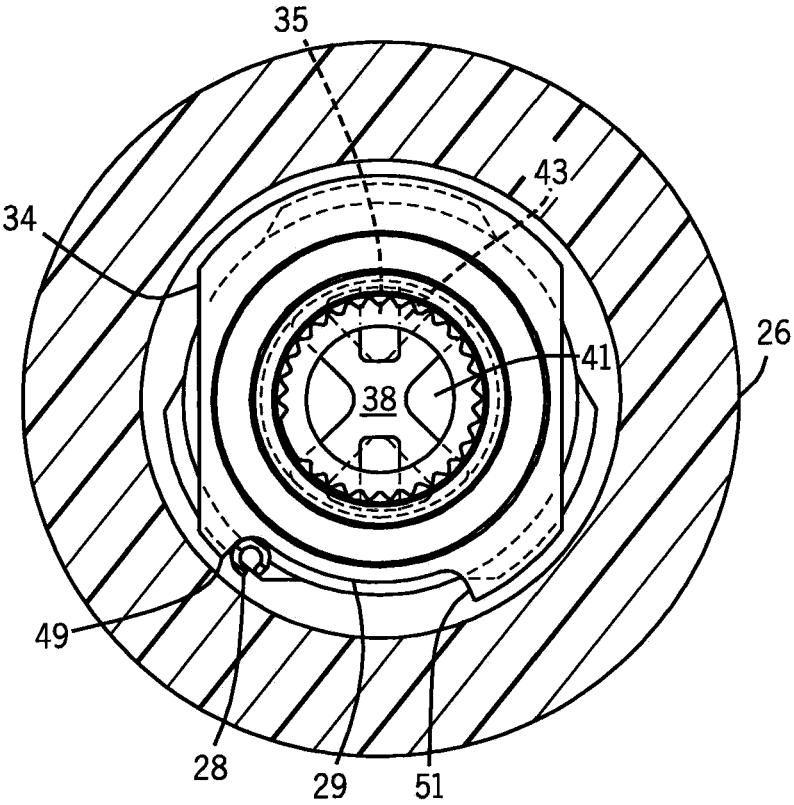
FIG. 6 is a view in section taken along line 6-6 of FIG. 5, showing the spray nozzle in a minimum flow position.
Figure 7:
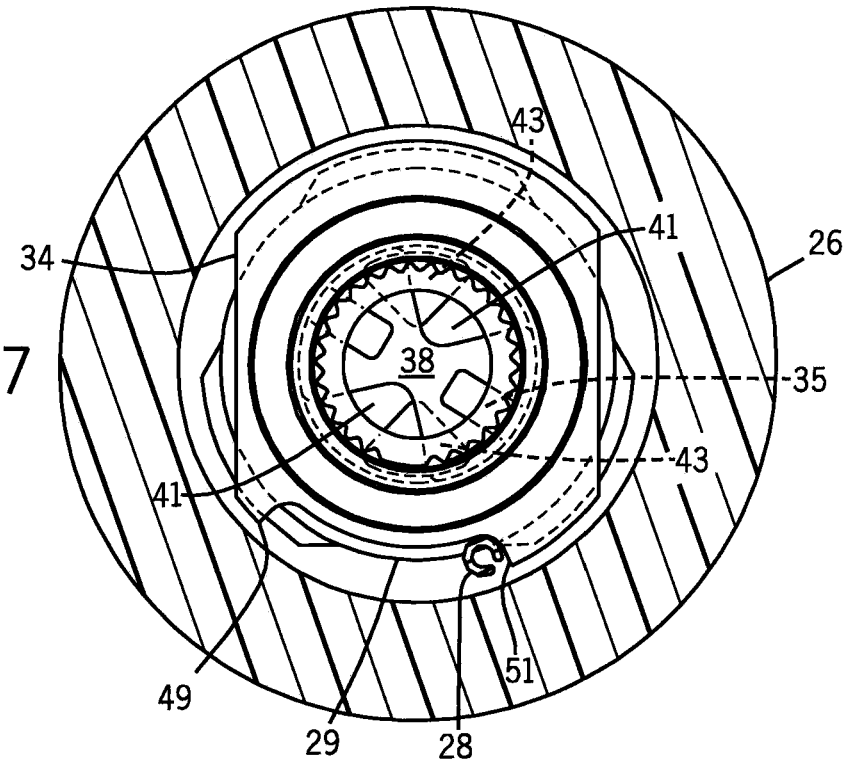
FIG. 7 is a view similar to FIG. 6, but showing the spray nozzle in a maximum flow position.

Referring first specifically to FIGS. 6 and 7, a cutaway view along line 6-6 of FIG. 5 is shown, illustrating the stop pin 28 in a minimum and maximum flow position while the index key 39 is in the key index receptacle 25. Referring first to FIG. 6, when stop pin 28 is positioned against stop surface 49, the apertures 41 in the movable disk 30 are completely out of alignment with the apertures 43 in the stationary disk 40, completely shutting off fluid flow from the water supply through the ceramic disk valve 45. Referring now to FIG. 7, when the stop pin 28 is moved to the opposing stop surface 51, the aperture 41 in the movable disk 38 is aligned over a portion of the aperture 43 allowing a predetermined maximum flow of water through the valve. Here, the maximum flow is selected to be a partial flow, where the opening 41 remains partially blocked when positioned over aperture 43. The overall range of flow when the index key 39 is in this position, therefore, ranges between a minimum level where flow is completely shut off, and a selected maximum level.

Figure 8:
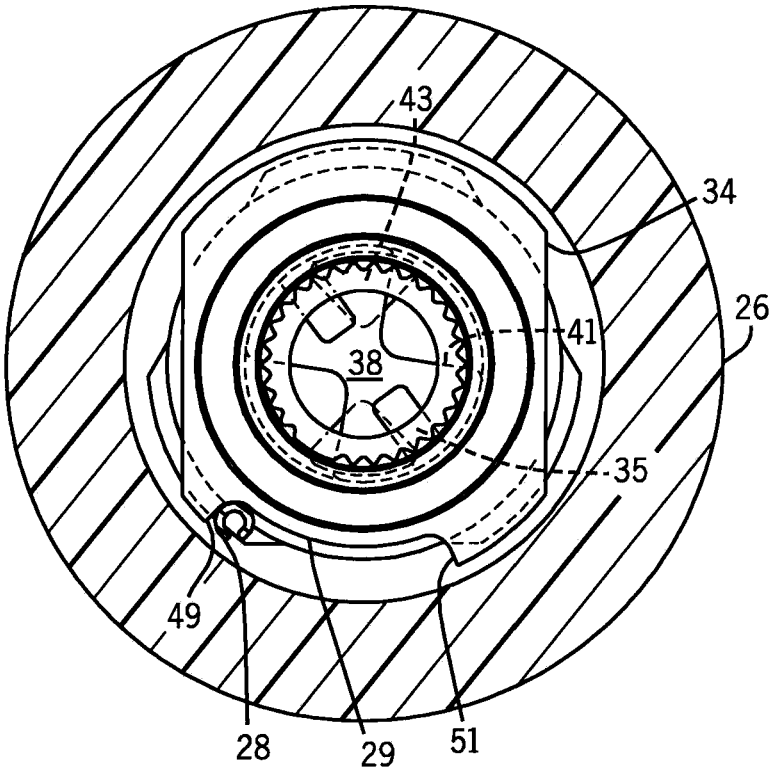
FIG. 8 is a view similar to FIG. 6, but showing the spray nozzle in a minimum flow position when the index key is in a second position.
Figure 9:
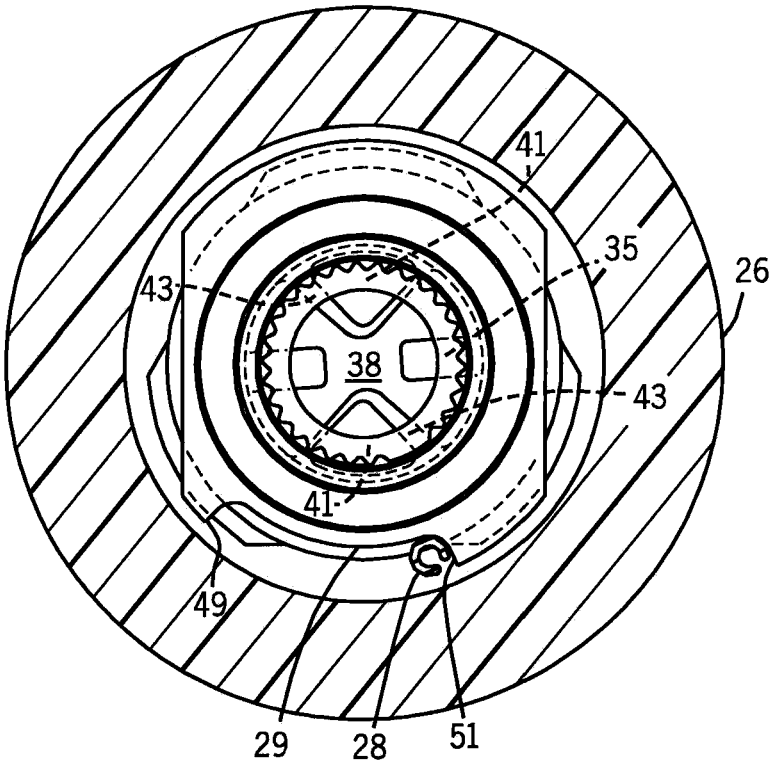
FIG. 9 is a view similar to FIG. 7, but showing the spray nozzle in a maximum flow position when the index key is in the second position.

Referring now to FIGS. 8 and 9, the stop pin 28 is shown in a minimum and a maximum flow position, respectively, while the index key 39 is in the key index receptacle 27. Referring first to FIG. 8, when stop pin 28 is positioned against stop surface 49, the apertures 41 in the movable disk 30 are in a first position in minimal alignment with the apertures 43 in the stationary disk 40, providing only a predetermined minimum flow of fluid from the water supply through the ceramic disk valve 45. Referring now to FIG. 7, when the stop pin 28 is moved to the opposing stop surface 52, the aperture 41 in the movable disk 38 is aligned over a larger portion of the aperture 43 allowing a predetermined maximum flow of water through the valve 45.

It will be appreciated that the use of the ceramic disk valve in the body spray nozzle provides for a compact, low profile construction, which saves space in and/or behind the shower stall, and also provides an aesthetically pleasing profile. The body spray nozzle of the present invention, moreover, provides this low profile construction while also providing the ability to tilt the spray in various orientations. It will also be appreciated that the body spray nozzle disclosed herein provides many functional advantages in the low profile body, including the ability to adjust the range of flow levels. Thus, the invention provides an improved spray nozzle.

While the preferred embodiment has been described above, a number of modifications and changes may be made without departing from the spirit and scope of the invention. For example, while the spray nozzles have been shown as tiltable, a similar construction could be used to provide a stationary spray nozzle. Further, although a key index having two selectable range adjustments has been shown, more range variations could be provided, and that the body spray nozzle can also be constructed with a single index key, or without an index key. Additionally, although the valve stem is described as coupled to the stem driver ball through meshed teeth, other mechanical linkage systems could also be used. All such and other modifications within the spirit of the invention are meant to be in the scope of the invention.

What is claimed is:

1. A body spray nozzle configured to receive supply fluid from a source and emit the supply fluid as a directed spray, comprising:

a body spray housing configured to be coupled to the source;

a rotatable stem driver ball;

a spray head housing coupled to the stem driver ball and configured to tilt about and rotate the stem driver ball; and a valve pivotally coupling the stem driver ball to the body spray housing, the valve including a movable disk positioned to control flow through the nozzle, the movable disk being operatively coupled to the stem driver ball, wherein when the stem driver ball is rotated by the spray head housing, the movable disk is rotated to control the rate of flow through the nozzle.

2. The body spray nozzle as recited in claim 1, wherein a pin is coupled to an internal surface of the stem driver ball, and a groove is formed in a surface of the valve to receive the pin, the groove extending along a portion of the valve between a first and a second stop element, wherein as the pin is moved along the groove the position of the movable disk is adjusted, whereby the rate of flow through the valve can be is adjusted.

3. The body spray nozzle as recited in claim 1, wherein the valve includes a valve stem coupled to the movable disk, and the valve stem includes an index key that is selectively coupled to one of a first and a second index key receptacle in the stem driver ball, wherein the position of the index key selectively adjusts the position of the movable disk in the valve to adjust a range of available flow through the valve.

4. The body spray nozzle as recited in claim 3, wherein when the index key is in the first index key receptacle, the flow of the supply of fluid through the valve ranges between a shut off flow position and a selected maximum flow position, and when the index key is in the second index key receptacle, the flow of the supply of fluid through the valve ranges between a selected minimum flow position and a selected maximum flow position.

5. The body spray nozzle as recited in claim 3, wherein the valve stem comprises a plurality of teeth, the stem driver ball comprises a plurality of mating teeth that mesh with the teeth in the valve stem, the index key comprises a tooth that is wider than the other teeth in the valve stem, and the index key receptacles comprise a first and a second opening in the stem driver ball of substantially equivalent width to the index key.

6. The body spray nozzle as recited in claim 3, wherein the valve further comprises a stationary disk including at least one aperture, the movable disk is adapted to selectively open and close at least a portion of the aperture in the stationary disk, and the position of the index key in the first or the second index key receptacle determines a position of the movable disk relative to the stationary disk.

7. The body spray nozzle as recited in claim 1, wherein the valve further comprises a stationary disk including at least one aperture, and the movable disk is adapted to selectively open and close at least a portion of the aperture in the stationary disk.

8. The body spray nozzle as recited in claim 1, wherein the valve is in the form of a ceramic disk valve.

9. The body spray nozzle as recited in claim 1, wherein the valve includes a valve stem comprising at least one coupling element for coupling the valve stem to the movable disk, and the valve stem is coupled to and rotatable with the stem driver ball.

10. The body spray nozzle as recited in claim 1, wherein the valve stem comprises a plurality of teeth and the stem driver ball comprises a plurality of mating teeth, the teeth and the mating teeth being meshed together wherein when the valve stem driver ball is rotated, the valve stem and movable disk are also rotated.

11. The body spray nozzle as recited in claim 10, further comprising a stationary disk having at least one aperture, and the movable disk comprises an opening where when the valve stem driver ball is rotated, the opening in the movable disk is selectively aligned over the aperture in the stationary disk.

12. A body spray nozzle configured to receive a fluid from a source, comprising:

a body spray housing configured to be coupled to the source;

a rotatable stem driver ball;

a spray head housing coupled to an exterior surface of the stem driver ball and configured to rotate the stem driver ball; and a valve pivotally coupling the stem driver ball to the body spray housing, the valve comprising:

a valve stem coupled to the stem driver ball;

a movable disk coupled to the valve stem; and a stationary disk including at least one aperture;

wherein when the stem driver ball is rotated by the spray head housing, the valve stem and movable disk are selectively rotated relative to the stationary disk between at least a first position in which a supply of water flows into the valve, and a second position in which the supply of water is to at least some extent prevented from flowing into the valve.

13. The body spray nozzle as recited in claim 12, wherein the valve stem comprises a plurality of teeth, and the stem driver ball comprises a plurality of mating teeth.

14. The body spray nozzle as recited in claim 13, wherein at least one of the plurality of teeth in the valve stem is formed to be wider than the other teeth in the valve stem to provide an index key, and wherein the stem driver ball comprises at least a first and a second index key receptacles sized to mate with the index key, wherein the index key is selectively positionable in one of the first and second index key receptacles to adjust an angle between the movable disk and the stationary disk.

15. The body spray nozzle as recited in claim 12, wherein the valve further comprises a valve body coupled to the valve stem, and the valve body comprises a flow control groove having a first stop surface and a second stop surface, and wherein the stem driver ball includes a stop pin that moves along the flow control groove to limit the flow through the valve between a selected minimum and a selected maximum value.

16. The body spray nozzle as recited in claim 12, wherein the stationary disk and valve stem are disposed on opposing sides of the moveable disk.

17. A body spray nozzle configured to receive a fluid from a source and emit the fluid as a directed spray, comprising:

a body spray housing configured to be coupled to the source;

a hollow stem driver ball defining a cavity therein;

a spray head housing coupled to an exterior surface of the stem driver ball and configured to tilt about and rotate the stem driver ball; and a valve disposed in the cavity of the stem driver ball and pivotally coupling the stem driver ball to the body spray housing to control flow of the fluid through the nozzle;

wherein when the stem driver ball is rotated by the spray head housing, the valve is rotated to control the rate of flow through the nozzle.

18. The body spray nozzle as recited in claim 17, wherein the valve includes a moveable disk configured to control flow through the nozzle.

19. The body spray nozzle as recited in claim 18, wherein when the stem driver ball is rotated, the moveable disk is rotated to control the rate of flow through the nozzle.

20. The body spray nozzle as recited in claim 17, further comprising an escutcheon disposed between the stem driver ball and the body spray housing.

* * * * *